US009473845B2

(12) United States Patent
Weil et al.

(10) Patent No.: US 9,473,845 B2
(45) Date of Patent: Oct. 18, 2016

(54) ACTIVE NOISE CANCELLING EAR PHONE SYSTEM

(75) Inventors: Richard Weil, London (GB); Steven Llewellyn, Thatcham (GB)

(73) Assignee: Cirrus Logic, Inc., Austin, TX (US)

( * ) Notice: Subject to any disclaimer, the term of this patent is extended or adjusted under 35 U.S.C. 154(b) by 510 days.

(21) Appl. No.: 13/992,196

(22) PCT Filed: Dec. 9, 2011

(86) PCT No.: PCT/GB2011/052444

§ 371 (c)(1),
(2), (4) Date: Jun. 6, 2013

(87) PCT Pub. No.: WO2012/076900

PCT Pub. Date: Jun. 14, 2012

(65) Prior Publication Data

US 2013/0266150 A1 Oct. 10, 2013

(30) Foreign Application Priority Data

Dec. 10, 2010 (GB) ..... 1020962.5
Apr. 14, 2011 (GB) ..... 1106335.1

(51) Int. Cl.
*H04R 1/10* (2006.01)
*G10K 11/178* (2006.01)
*H04R 3/00* (2006.01)

(52) U.S. Cl.
CPC ..... *H04R 1/1083* (2013.01); *G10K 11/1782* (2013.01); *H04R 3/00* (2013.01); *H04R 2460/01* (2013.01)

(58) Field of Classification Search
CPC .... H04R 1/10; H04R 25/00; H04R 2225/49; H04R 2460/01
USPC ..... 381/74, 312, 317–318
See application file for complete search history.

(56) References Cited

U.S. PATENT DOCUMENTS 6,353,671 B1 * 3/2002 Kandel ..... H04R 25/453 381/312
8,130,991 B2 * 3/2012 Rasmussen ..... H04R 25/453 381/317
8,249,259 B2 * 8/2012 Marumoto ..... H03G 3/32 381/318
2007/0201717 A1 8/2007 Dyer et al.
2008/0137878 A1 6/2008 Killion et al.

(Continued)

FOREIGN PATENT DOCUMENTS

CN 201185472 Y 1/2009
CN 101385387 A 3/2009

(Continued)

*Primary Examiner* — Suhan Ni
(74) *Attorney, Agent, or Firm* — Blank Rome LLP

(57) ABSTRACT

An earphone has a casing, containing a speaker, the casing being adapted to fit within the outer ear of a user at the entrance to the ear canal of the user. The casing has a guide, protruding from the front surface of the casing, and suitable for locating in the ear canal of the user. The casing is also adapted to allow sound to pass through a sound-permeable portion of the front surface. The casing has sound channels, leading across the front surface of the casing from the sound-permeable portion to a periphery of the first surface of the casing. The earphone can be used in a noise cancelling earphone system, with signal processing circuitry connected to the microphone and to the speaker, wherein the signal processing circuitry is adapted to receive the ambient noise signal from the microphone, and to apply the ambient noise signal to a filter having a controllable amount of gain, for generating a noise cancellation signal for transmission to the speaker. The result is that, however the earphone is worn within the outer ear of a user, an amount of sound leakage lies within a predetermined range, such that the amount of gain to be applied by the signal processing circuitry falls within a relatively narrow range.

3 Claims, 10 Drawing Sheets

(56) References Cited

U.S. PATENT DOCUMENTS

| | | | |
|---|---|---|---|
| 2008/0144870 | A1 | 6/2008 | Oliveira et al. |
| 2009/0046867 | A1 | 2/2009 | Clemow |
| 2009/0147971 | A1 | 6/2009 | Kuhr et al. |
| 2010/0177904 | A1 | 7/2010 | Sung et al. |
| 2011/0268308 | A1 | 11/2011 | Vasquez |
| 2012/0148061 | A1 | 6/2012 | Llewellyn |

FOREIGN PATENT DOCUMENTS

| | | | |
|---|---|---|---|
| CN | 101433097 | A | 5/2009 |
| CN | 201479347 | | 5/2010 |
| EP | 1 727 390 | A2 | 11/2006 |
| GB | 2437772 | A | 11/2007 |
| GB | 2 446 982 | A | 8/2008 |
| GB | 2 454 605 | A | 5/2009 |
| RU | 2 223 612 | C2 | 2/2004 |
| WO | WO 99/30531 | A2 | 6/1999 |
| WO | WO 2008/112444 | A1 | 9/2008 |
| WO | WO 2009/067085 | A1 | 5/2009 |
| WO | WO 2010/140087 | A1 | 12/2010 |
| WO | WO 2011/025835 | A1 | 3/2011 |

* cited by examiner

ACTIVE NOISE CANCELLING EAR PHONE SYSTEM

This invention relates to an earphone, and in particular to an earphone for use in a noise cancellation system.

It is known to provide a noise cancellation system, for use with a sound-reproducing device such as an earphone. The sound-reproducing device includes a speaker, for receiving electrical signals representing a wanted sound, such as music or speech, from a portable music player, telephone handset, or the like. The noise cancellation system includes a microphone provided on the sound-reproducing device, to generate an electrical signal representing ambient noise. This ambient noise signal is then applied to signal processing circuitry to generate a noise cancellation signal, and the noise cancellation signal is applied to the speaker.

The purpose of the signal processing circuitry is to generate a noise cancellation signal that, when applied to the speaker, produces a sound that is equal in magnitude but opposite in phase to the ambient sounds reaching the user's ear. If this can be achieved, destructive interference will have the effect of reducing the noise that can be heard by the user.

In order to achieve this, it is known, for example from GB-2445984A, that the signal processing circuitry needs to apply frequency-selective filtering to the ambient noise signal, and that this frequency-selective filtering needs to take account of the frequency-dependent amplitude and phase characteristics of: the response of the noise microphone; any electronic amplification in the signal processing circuitry; and the response of the speaker. These characteristics are generally relatively stable for any given individual earphone device and, subject to manufacturing tolerances, they can be determined for any model of earphone.

In addition, however, the frequency-selective filtering needs to take account of two further factors, namely the frequency-dependent amplitude and phase characteristics of the acoustic path from the surroundings into the ear of the user, and the phase and frequency response of the acoustic path from the speaker to the ear of the user. These are both dependent on the leakage characteristics of the earphone, that is, the leakage in the coupling of the earphone to the ear of the wearer.

It is known that the frequency-dependent characteristics of the leakage path can vary widely, depending on how the sound-reproducing device interacts with the ear of the user. More specifically, one important factor is the area of the leakage, which affects both the amplitude and phase of all signals perceived by the ear. For example, in the case of an earphone that is intended to be worn within the outer ear of the user, the frequency-dependent leakage characteristics will depend on the exact shape of the user's ear, and on how tightly the earphone is pushed into the ear.

This has the effect that it is difficult to perform frequency-selective filtering that is sufficiently representative of the frequency-dependent amplitude and phase leakage characteristics.

According to a first aspect of the present invention, there is provided a noise cancelling earphone system, comprising:

an earphone, having a microphone for detecting ambient noise and generating an ambient noise signal, and a speaker, and signal processing circuitry, connected to the microphone and to the speaker, wherein the signal processing circuitry is adapted to receive the ambient noise signal from the microphone, and to generate a noise cancellation signal for transmission to the speaker, wherein the earphone comprises:

a casing, containing the speaker, wherein the casing is adapted to fit within the outer ear of a user at the entrance to the ear canal of the user, and wherein the casing has a front surface through which sound from the speaker can pass; and a cushion, extending around the front surface of the casing, wherein the cushion extends discontinuously around a periphery of the front surface of the casing.

According to a second aspect of the present invention, there is provided an earphone, comprising:

a casing, containing a speaker, wherein the casing is adapted to fit within the outer ear of a user at the entrance to the ear canal of the user;

wherein the casing has a front surface intended to be located adjacent to the entrance to the ear canal of the user;

wherein the casing is adapted to allow sound to pass through a sound-permeable portion of the front surface; and wherein the casing has a plurality of ridges on a front surface thereof, defining at least one sound channel, leading across the front surface of the casing from the sound-permeable portion to a periphery of the first surface of the casing.

This has the advantage that the amount of ambient noise that leaks past the earphone cannot be less than a certain minimum value, regardless of how tightly the earphone is pushed into the ear. Hence, the range of possible amplitudes in the characteristic of the leakage path is reduced, meaning that it is possible to perform frequency-selective filtering that is more likely to be representative of the frequency-dependent amplitude and phase leakage characteristics.

For a better understanding of the present invention, and to show how it may be put into effect, reference will now be made, by way of example, to the accompanying drawings, in which.

Figure 1:
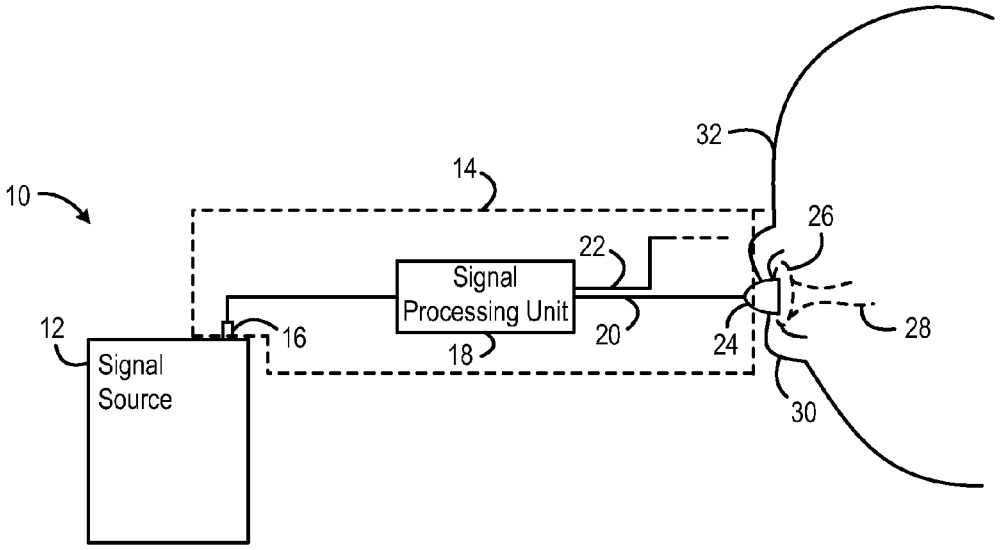
FIG. 1 illustrates the use of an earphone in accordance with an aspect of the present invention.

FIG. 1 shows a sound reproduction system 10, including a signal source 12 and an earphone system 14. The signal source 12 might be a playback device such as an MP3 player, or a device for receiving sound signals such a mobile phone handset, or the like.

The earphone system 14 may include a jack 16 that plugs into the signal source 12, and a signal processing unit 18.

Although a separate signal processing unit 18 is shown in FIG. 1, the invention is equally applicable to systems in which the signal processing takes place within the signal source, or even within the earphones themselves.

In this example, the sound reproduction system 10 is a stereo system, and so the signal processing unit 18 includes respective leads 20, 22 connected to two earphones, of which only one earphone 24 is shown in FIG. 1, it being understood that the other earphone of the pair is simply a mirror image of the first. The leads 20, 22 may each be made up of several wires, allowing separate signals to be passed along them, as described in more detail below.

The earphone 24 is of a size and shape that allows it to fit within the concha 26 at the entrance to the ear canal 28 in the outer ear 30 of a user 32.

Figure 2:
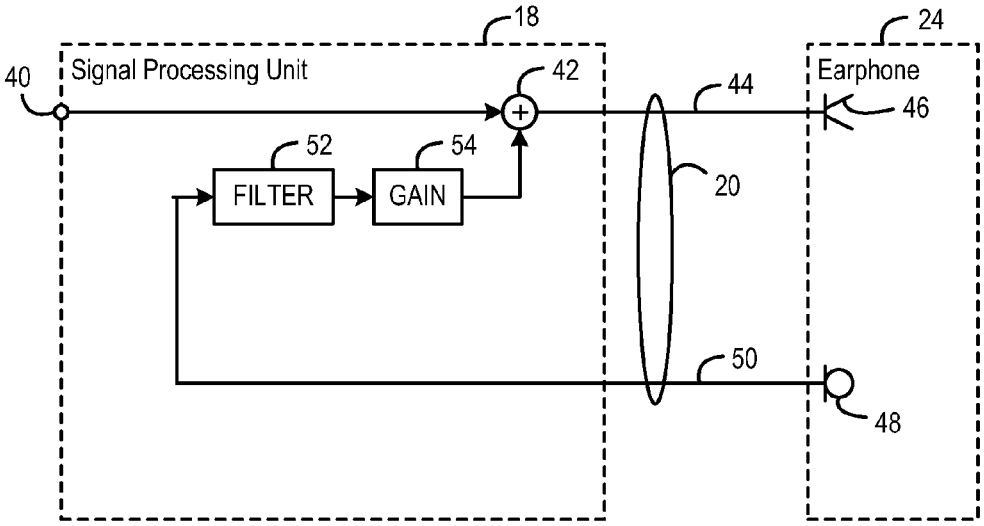
FIG. 2 shows a first noise cancellation system for use with the earphone of the present invention.

FIG. 2 shows the general form of the noise cancellation system within the sound reproduction system 10. Specifically, the signal processing unit 18 receives a wanted signal from the signal source 12 on an input 40. This might for example be the signal representing the speech or music that the user wishes to hear.

The wanted signal is applied to a first input of an adder 42, and the output from the adder 42 is output over a first wire 44 in the lead 20 to a speaker 46 in the earphone 24.

The earphone 24 also includes at least one microphone 48, for detecting ambient noise in the vicinity of the earphone. Ambient noise signals from the microphone 48 may be passed along a second wire 50 in the lead 20 to the signal processing unit 18.

The ambient noise signals are passed to a filter 52, and to a gain unit 54 to generate a noise cancellation signal, which is applied to a second input of the adder 42, so that it is added to the wanted signal as the latter is supplied to the speaker 46.

If the signal processing performed by the filter 52 and gain unit 54 in the signal processing unit 18 can be controlled appropriately, then the effect of applying the noise cancellation signal to the speaker 46 is to generate a sound that will cancel out the ambient noise to at least some extent, thereby making the wanted sounds more clearly audible.

As is well known, effective noise cancellation requires that the filter characteristics of the filter 52 and the gain unit 54 should be well matched to the other characteristics of the system. Thus, the filter 52 can have a frequency response characteristic that compensates for any frequency dependent variations in the responses of the ambient noise microphone 48 or the loudspeaker 46. Also, the filter 52 can have a frequency response characteristic that compensates for any frequency dependent variations in the ambient noise that reaches the user's ear around the earphone as it is worn. These characteristics of the filter 52 can be preset, based on knowledge of the earphone 24 with which the signal processing unit 18 is to be used.

The system shown in FIG. 2 is a pure feedforward system, in which the ambient noise signals are passed through a fixed filter 52 and gain unit 54. In other embodiments, the noise cancellation system can be an adaptive system, in which the earphone 24 also includes an error microphone, positioned close to the speaker 46, and error signals generated by the error microphone are used to adjust the characteristics of the filter 52 and/or the gain unit 54 in use, in order to minimise the error signals.

Whether the system is a pure feedforward system or an adaptive system, the level of gain applied by the gain unit 54 should be well matched to the characteristics of the system. One particularly relevant aspect of these characteristics can be described as the leakiness of the earphone.

When the earphone 24 is held loosely in the concha 26 of the ear of the user, there is a relatively high leakage. That is, the earphone 24 provides a low acoustic resistance to ambient sounds reaching the ear canal 28 of the user, and a low acoustic resistance to sounds from the speaker 46 reaching the exterior. In such circumstances, a relatively high degree of noise cancellation is required, and so the gain value applied in the gain unit 54 to the ambient noise signals received from the noise microphone 48 must be relatively high, if effective noise cancellation is to be achieved.

When the earphone 24 is held tightly over the entrance to the ear canal 28 of the user, it provides a high acoustic resistance to ambient sounds reaching the ear canal, and similarly a high acoustic resistance to sounds from the speaker 46 reaching the ambient environment, and there is said to be a relatively low leakage. In such circumstances, there is less noise reaching the ear requiring cancellation, and so the gain value applied in the gain unit 54 to the ambient noise signals received from the noise microphone 48 must be relatively low, if acceptable noise cancellation is to be achieved.

In the illustrated embodiment, the gain value applied by the gain unit 54 is fixed, and so it is necessary to select a gain value that provides an acceptable degree of noise cancellation, however the earphone is used by the user.

Figure 3:
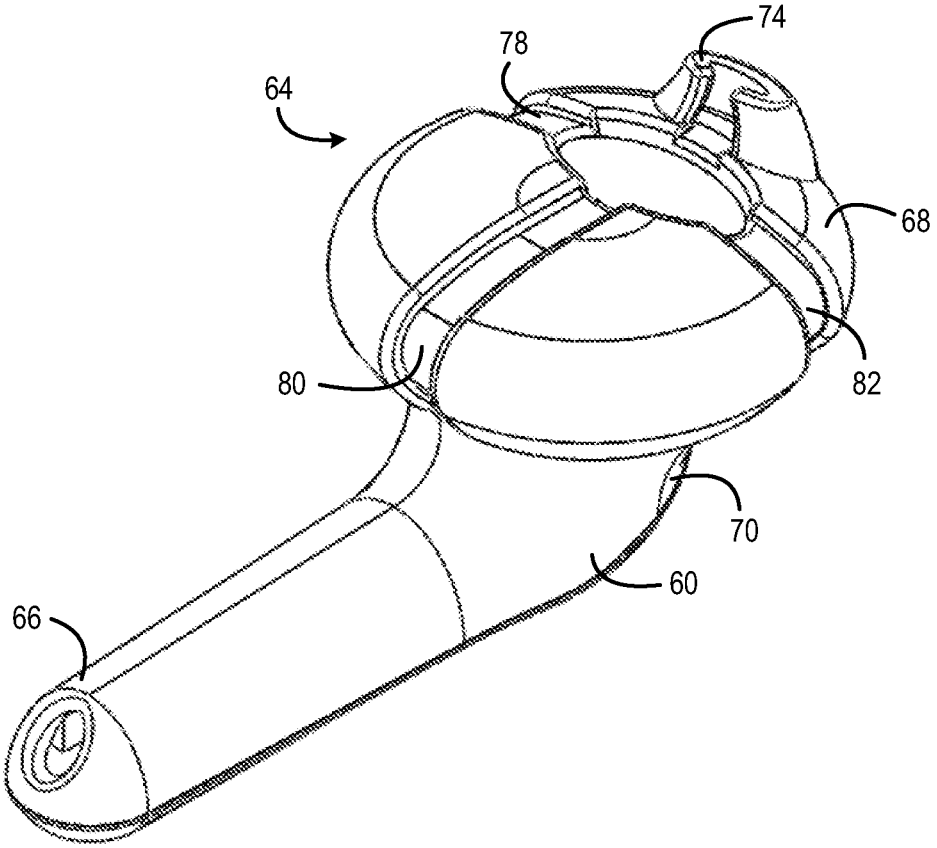
FIG. 3 is a perspective view, showing the form of the earphone in accordance with an aspect of the present invention.
Figure 4:
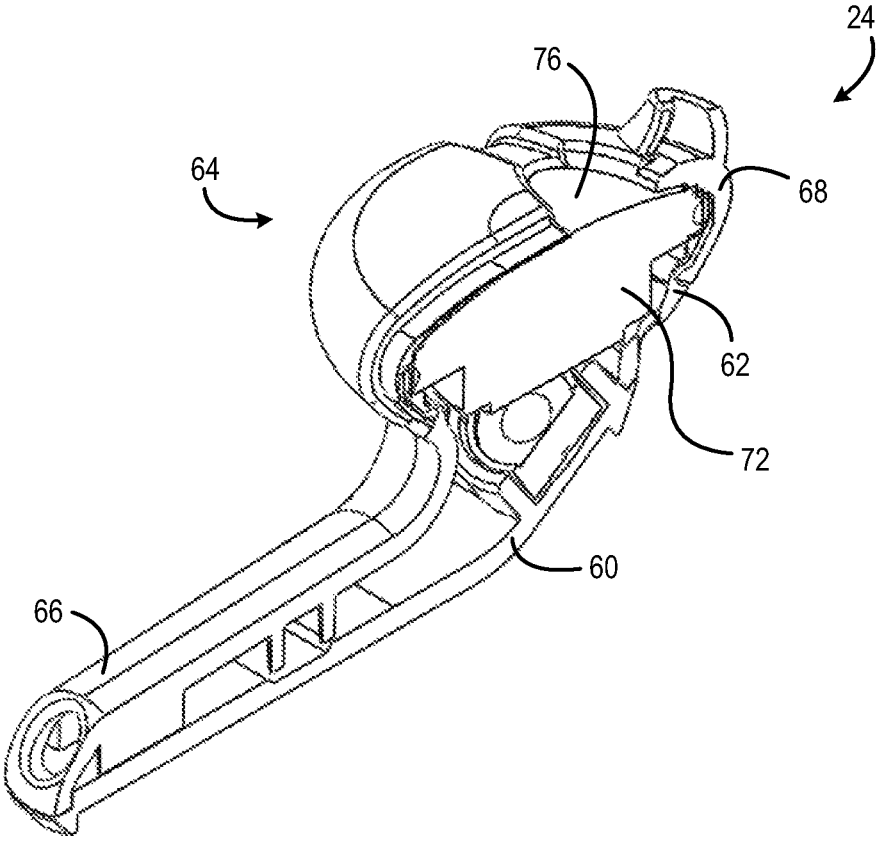
FIG. 4 is a cutaway view, showing the earphone of FIG. 3.

FIGS. 3 and 4 show a form of earphone 24, in which the range of leakage values is restricted, despite differences in how the earphone might be worn in the ear of the user.

Specifically, FIGS. 3 and 4 show an earphone 24, having a casing 60. In this embodiment, the casing 60 includes a casing body 62, which has a first end region 64 that is of a size and shape that allows it to be placed in the outer ear of the user, adjacent to the entrance to the user's ear canal. A second opposite end region 66 of the casing body 62 receives the lead 20 (not shown in FIGS. 3 and 4). The casing body 62 may be made of a rigid plastic material, or any other suitable material that is rigid enough for the intended use.

In this embodiment, the casing 60 also includes a cushion 68 mounted around the periphery of the first end region 64 of the casing body 62. The cushion 68 may be made of a plastic material or any other material that is suitable for the intended use. The cushion may be made of a material, such as plastic or rubber, that is less rigid, i.e. softer, than the casing body 62, and may be designed to be removable from the casing body 62 by slight stretching, so that it can be replaced if necessary. In this case, the cushion 68 acts as a gasket, providing a partial seal between the casing body 62 and the outer ear of the user.

In other embodiments, the casing can have a unitary structure. That is, the casing body and the cushion can be formed as a single body.

The casing body 62 also has one or more holes 70, allowing ambient sound to enter the casing.

The casing 60 defines an internal space 72, into which can be fitted the speaker 46 and the microphone 48. The speaker 46 (not shown in FIG. 4) is positioned and oriented so that it directs sound out of the casing 60, that is, upwards in the orientation shown in FIG. 4. A suitable speaker will typically direct sound out through a surface that is covered by a sound-permeable but water-resistant material, such as a mesh.

The microphone 48 (not shown in FIG. 4) is positioned so that it can detect ambient sound entering through the hole 70.

Figure 5:
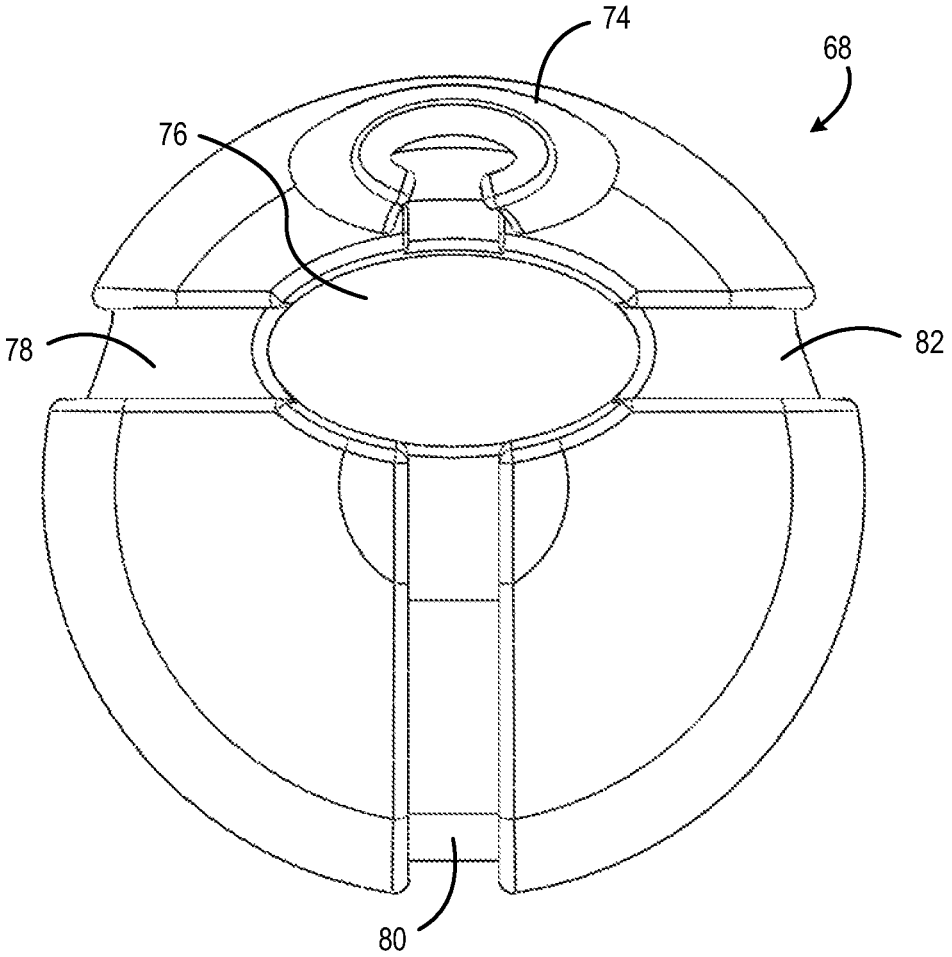
FIG. 5 is a plan view of a cushion of the earphone of FIG. 3.
Figure 6:
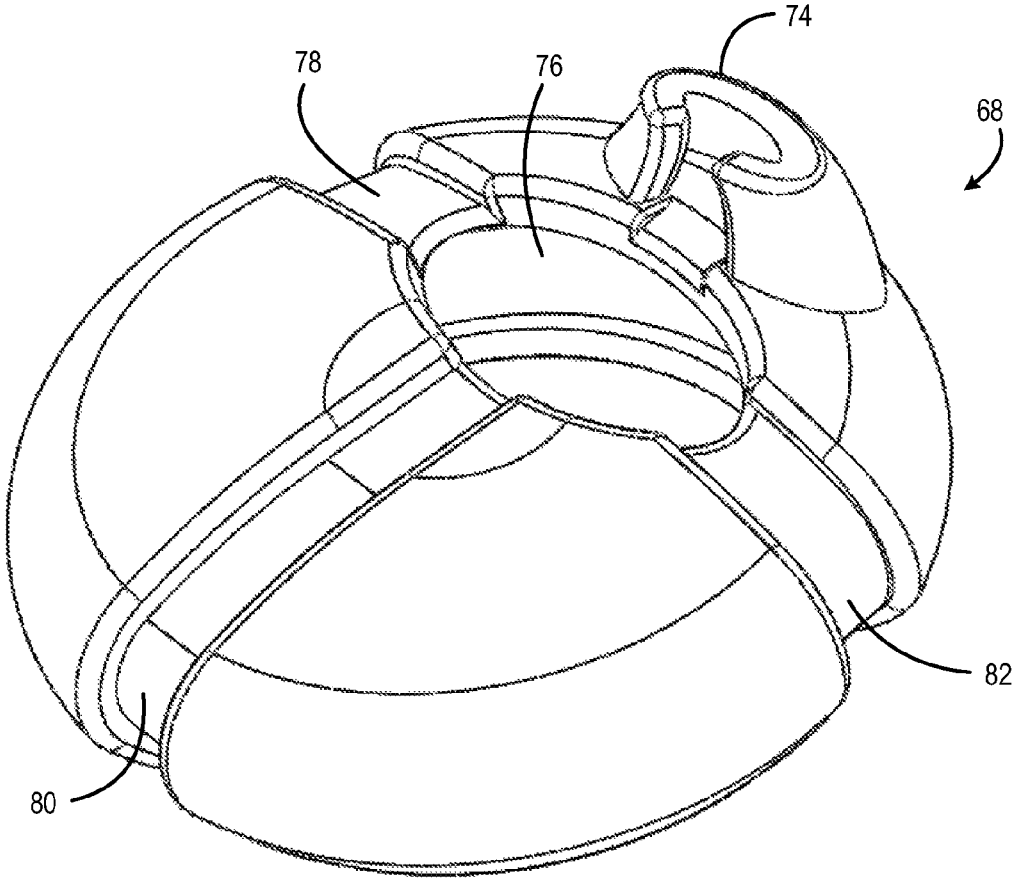
FIG. 6 is a perspective view of the cushion of FIG. 5.
Figure 7:
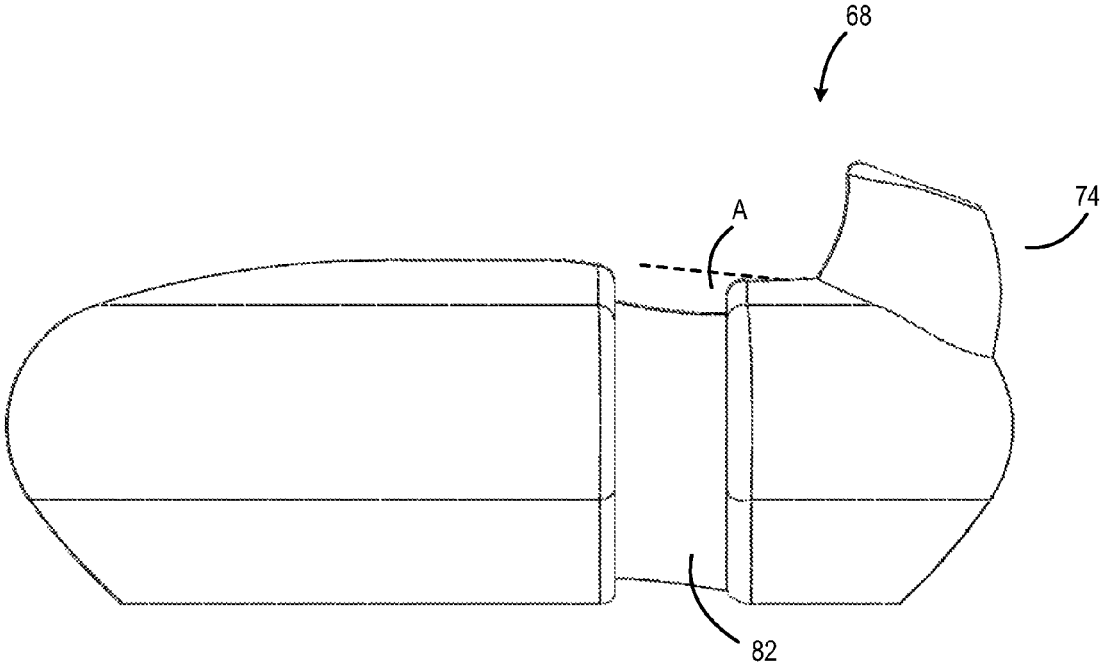
FIG. 7 is a side view of the cushion of FIG. 5.

FIGS. 5, 6 and 7 show the cushion 68 removed from the casing body 62. Specifically, FIG. 5 is a plan view of the cushion 68, FIG. 6 is a perspective view from above, and FIG. 7 is a side view.

The cushion 68 has a guide 74 protruding from its upper surface. The guide 74 is designed to be located in the entrance to the ear canal of the user, so that it assists in correct positioning of the earphone 24 in the outer ear of the user. Thus, the cross-sectional area of the guide 74 is smaller than the area of the entrance to the ear canal of the user so that it does not significantly prevent sound from entering the ear canal.

When seen in plan view, as seen most clearly in FIG. 5, the cushion 68 is generally circular, and the guide 74 is located close to the outer periphery of the cushion 68, at a position that is diametrically opposed to the direction in which the second end 66 of the casing body 62 extends.

A sound aperture 76 is provided in the upper surface of the cushion 68. As can be seen, the aperture 76 is of a generally elliptical shape, and it is formed in the half of the circular shape of the cushion 68 that is nearest to the guide 74. This has the effect that the aperture 76 is positioned close to the entrance to the user's ear canal in use. The upper surface of the cushion 68 surrounding the aperture 76 is typically substantially impermeable to sound, so that all of the sound generated by the speaker 46 passes through the aperture 76. Although an aperture is shown here, it would equally be possible to provide an area that is more permeable to sound than its surrounding area of the upper surface.

In addition, the guide 74 has a generally concave cross-sectional shape, as seen most clearly in FIGS. 5 and 6, so that sound passing through the aperture 76 is guided into the ear canal of the user when the earphone is being worn as described above.

The cushion also has three predetermined sound leakage channels 78, 80, 82, which are formed in the upper surface of the cushion 68, and extend from the aperture 76 towards the outer periphery of the cushion 68. More specifically, the channel 80 leads from the aperture 76 in a direction directly away from the guide 74, while the channels 78, 82 are opposite each other, and are each perpendicular to the channel 80. Although three sound channels are shown here, any suitable number of channels (for example in the range from two to six, inclusive) can be provided.

The result of forming the predetermined sound leakage channels 78, 80, 82 in the upper surface of the cushion 68 is that the upper surface is discontinuous where it contacts the surface of the user's concha 26.

The effect of this discontinuity is that the earphone 24 is unable to provide an acoustic seal for the entrance to the user's ear canal 28, and hence that there will always be a significant amount of leakage of ambient noise past the earphone 24 into the user's ear, and of sounds from the speaker 46 to the environment. This has the result that, in use, the acoustic resistance to ambient sounds reaching the ear canal 28 of the user cannot reach a very high value, regardless of how the user chooses to wear the earphone, and in particular regardless of how tightly the user attempts to press the earphone into his concha.

Although the acoustic impedance to ambient sounds reaching the ear canal 28 of the user will still vary, depending on how the user chooses to wear the earphone, the range of this possible variation will be less than would be the case if an acoustic seal could be formed.

The amount of sound leakage of ambient noise past the earphone 24 into the user's ear can conveniently be discussed in terms of the area of the available leakage paths. For example, in the case of an earphone having a smooth upper surface, for one typical user this leakage area might be in the region of 5 $mm^2$ if the device is pressed against the surface of the concha, increasing to 10 $mm^2$ if the earphone is worn loosely in the ear. These leakage areas will also vary from one user to another. Thus, wearing the earphone more loosely can increase the leakage area by 100%.

This means that it is necessary to attempt to select the characteristics of the filter 52 and/or the gain unit 54 in such a way that it provides acceptable noise cancellation across this range of leakage areas. However, the large percentage variation in the leakage area means that it is difficult to achieve this.

By contrast, in the case of an earphone as described here, if the predetermined sound leakage channels 78, 80, 82 have a total cross-sectional area of 10 $mm^2$, then the total available leakage area might be in the region of 15 $mm^2$ if the device is pressed against the surface of the concha, increasing to 20 $mm^2$ if the earphone is worn loosely in the ear. Thus, in this case, wearing the earphone more loosely can increase the leakage area by 33%.

FIG. 7 shows the cross-sectional area A of the predetermined sound leakage channel 82.

As before, it is necessary to attempt to select the characteristics of the filter 52 and/or the gain unit 54 in such a way that it provides acceptable noise cancellation across this range of leakage areas. However, the smaller percentage variation in the leakage area means that it is easier to achieve this. Furthermore, in an adaptive system, i.e. where the filter characteristics and/or the gain are adaptive, there will be a smaller range for adaptation, which is advantageous.

This means that the gain value applied in the gain unit 54 to the ambient noise signals received from the noise microphone 48 can be set to a relatively high value, and this will be suitable for providing effective noise cancellation across the range of leakage values that can be achieved.

Figure 8:
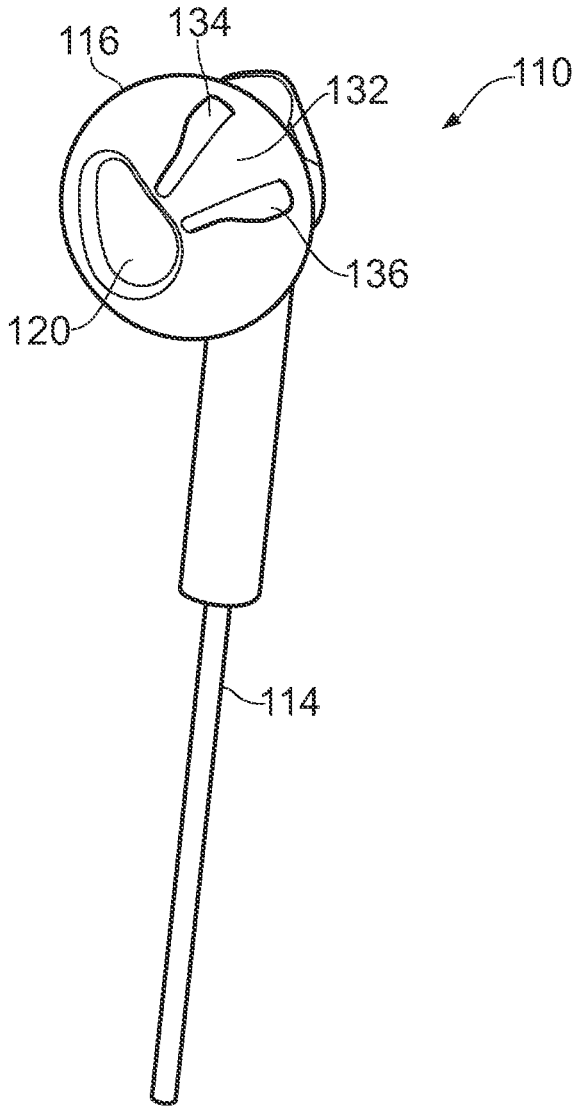
FIG. 8 is a perspective view, showing an alternative the form of the earphone in accordance with an aspect of the present invention.
Figure 9:
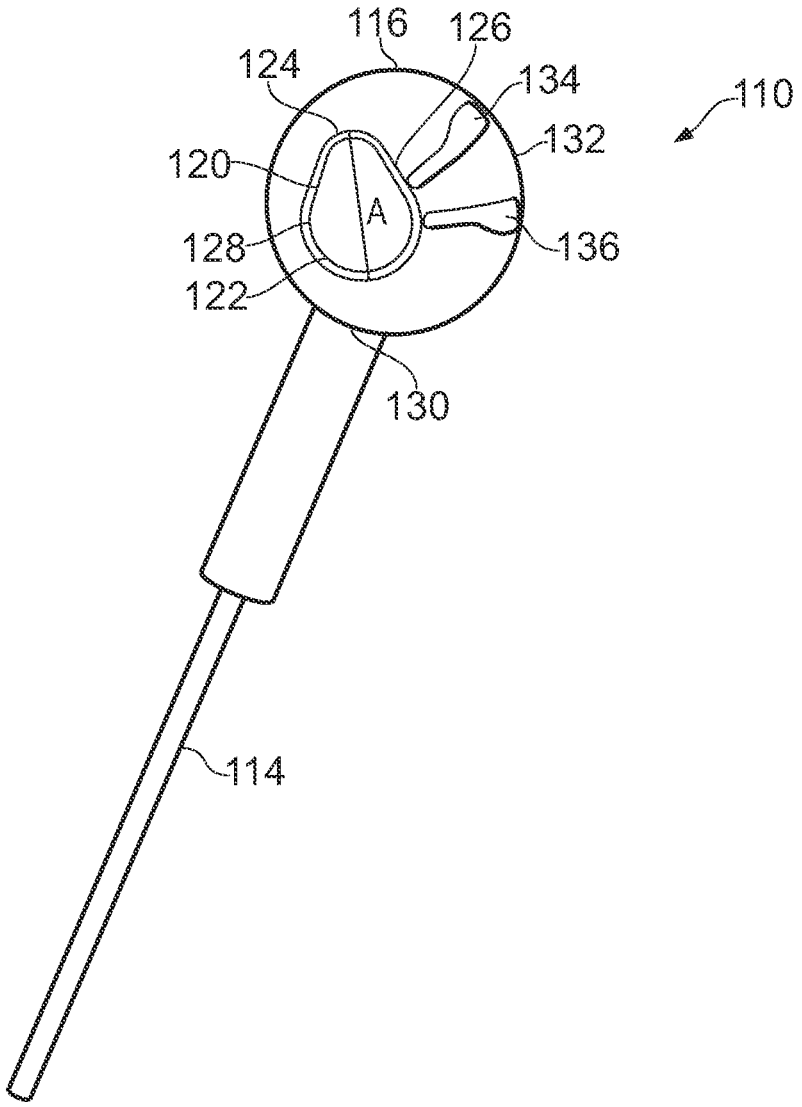
FIG. 9 is a plan view of the earphone of FIG. 8.
Figure 10:
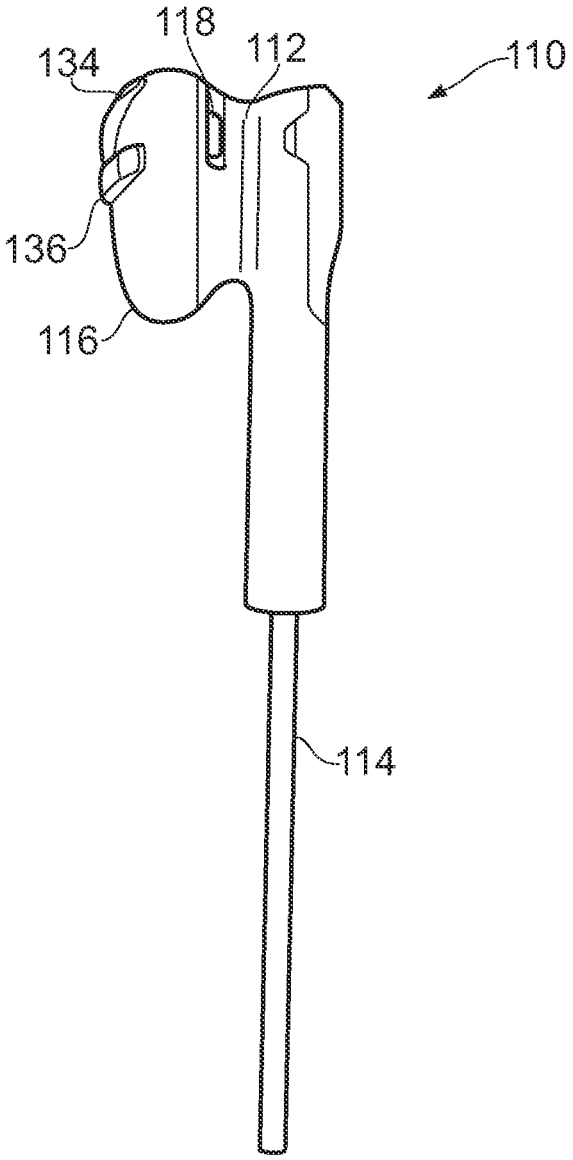
FIG. 10 is a side view of the earphone of FIG. 8.
Figure 11:
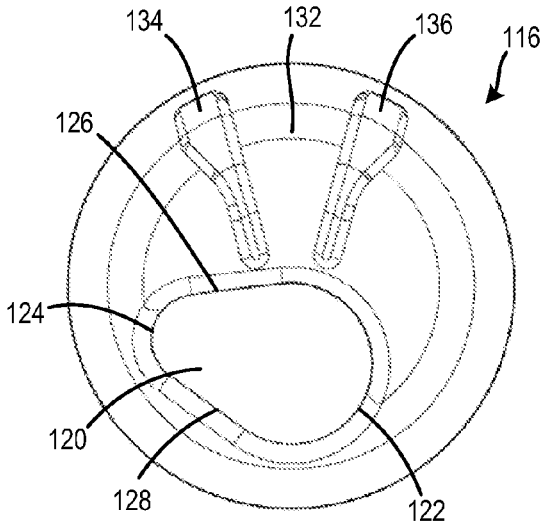
FIG. 11 is a plan view of a cushion of the earphone of FIG. 8.
Figure 12:
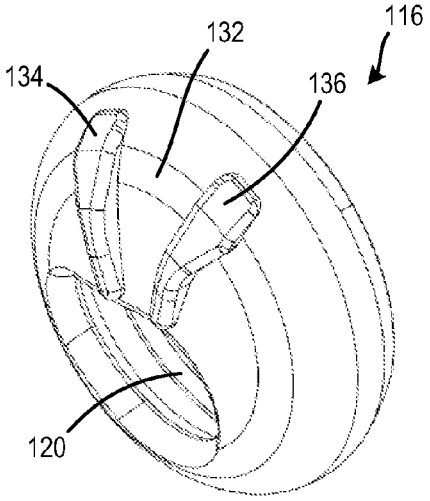
FIG. 12 is a perspective view of the cushion of FIG. 11.
Figure 13:
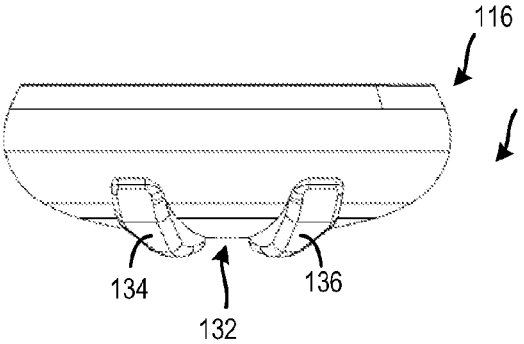
FIG. 13 is a first side view of the cushion of FIG. 11.
Figure 14:
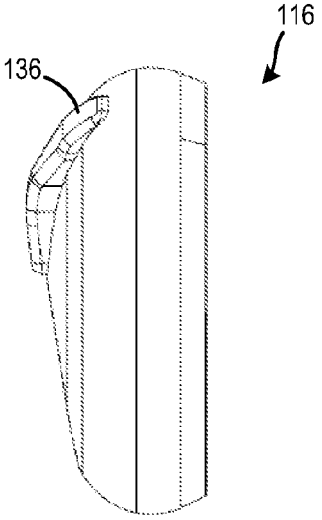
FIG. 14 is a second side view of the cushion of FIG. 11.

FIGS. 8, 9 and 10 show an alternative form of earphone 110 in accordance with the invention, with FIG. 8 being a perspective view, FIG. 9 being a plan view, and FIG. 10 being a side view. Again, in the earphone 110, the range of leakage values is restricted, despite differences in how the earphone might be worn in the ear of the user.

Specifically, FIGS. 8, 9 and 10 show an earphone 110, having a casing body 112, which receives a lead 114 that connects the earphone to the signal source. The casing body 112 may be made of a rigid plastic material, or any other suitable material that is rigid enough for the intended use.

In this embodiment, the casing body 112 also includes a cushion 116 mounted around an end region of the casing. The cushion 116 may be made of a plastic material or any other material that is suitable for the intended use. The cushion may be made of a material, such as plastic or rubber, that is less rigid, i.e. softer, than the casing body 112, and may be designed to be removable from the casing body 112 by slight stretching, so that it can be replaced if necessary. In this case, the cushion 116 acts as a gasket, providing a partial seal between the casing body 112 and the outer ear of the user.

In other embodiments, the casing can have a unitary structure. That is, the casing body and the cushion can be formed as a single body.

The casing body 112 also has one or more holes 118, allowing ambient sound to enter the casing, and a microphone may be positioned so that it can detect ambient sound entering through the hole.

The casing body 112 also contains the speaker for generating sound, and the casing body 112 has a surface that is covered by a sound-permeable but water-resistant material, such as a mesh, that the sound can be directed through.

FIGS. 11, 12, 13 and 14 show the cushion 116 separate from the casing body 112 of the earphone shown in FIGS. 8, 9 and 10.

The cushion 116 is typically substantially impermeable to sound, but the cushion 116 has a hole 120 for the sound that has passed through the surface of the casing, so that substantially all of the sound generated by the speaker passes through the hole 120. The sound aperture 120 has a shape defined by two circular arcs 122, 124 of different radii at its two ends, with the arcs being joined by straight lines 126, 128 along its sides.

When mounted on the casing body 112, the end defined by the larger radius arc 122 is located close to the point 130 at which the lead 114 enters the casing body 112, and the axis A of the shape extends at an angle of approximately 60° to the direction at which the lead 114 enters the casing body 112.

This has the effect that the aperture 120 is positioned close to the entrance to the user's ear canal in use.

The cushion 116 also has a predetermined sound leakage channel 132, defined by two ridges 134, 136, which are formed in the upper surface of the cushion 116, and extend from the aperture 120 towards the outer periphery of the cushion.

More specifically, the channel 132 leads from the centre of the aperture 120 in a direction at approximately 135° to the direction at which the lead 114 enters the casing body 112.

The channel 132 becomes wider in the direction from the aperture 120 towards the outer periphery of the cushion.

Two ridges 134, 136 and one sound channel 132 are shown here, but any suitable number of ridges and channels can be provided. In preferred embodiments of the invention, the total width of the ridges is less than 20% of the circumference of the upper surface of the cushion 116, and in this illustrated embodiment of the invention, the width of the ridges 134, 136 at their widest is 8-12% of the circumference of the upper surface of the cushion 116. In preferred embodiments of the invention, the channel or channels have a circumferential extent that is at least 10% of the circumference of the upper surface of the cushion 116, but is less than 50% of the circumference of the upper surface of the cushion 116. In this illustrated embodiment, the single channel has a circumferential extent that is approximately 10% of the overall circumference.

The result of forming the predetermined sound leakage channel 132 in the upper surface of the cushion 116 is that the upper surface is discontinuous where it contacts the surface of the user's concha.

Moreover, the ridges 134, 136 are sufficiently non-compliant that, when the device is worn in the user's concha, the sound leakage channel 132 still exists. That is, the device cannot readily be pushed into the concha in such a way as to form a seal therewith.

Compared with the embodiment shown in FIGS. 3-7, this has the advantage that a sound leakage channel is provided, without requiring a large increase in the overall size and weight of the earphone, relative to a conventional earphone in which the upper surface is generally continuous.

As discussed previously, the effect of this discontinuity is that the earphone 110 is unable to provide an acoustic seal for the entrance to the user's ear canal, and hence that there will always be a significant amount of leakage of ambient noise past the earphone 110 into the user's ear, and of sounds from the speaker to the environment. This has the result that, in use, the acoustic resistance to ambient sounds reaching the ear canal of the user cannot reach a very high value, regardless of how the user chooses to wear the earphone, and in particular regardless of how tightly the user attempts to press the earphone into his concha.

As before, therefore, when the earphone 110 is used in place of the earphone 24 in the system of FIGS. 1 and 2, it is necessary to attempt to select the characteristics of the filter 52 and/or the gain unit 54 in such a way that it provides acceptable noise cancellation across this range of leakage areas. However, the smaller percentage variation in the leakage area means that it is easier to achieve this. Furthermore, in an adaptive system, i.e. where the filter characteristics and/or the gain are adaptive, there will be a smaller range for adaptation, which is advantageous.

This means that the gain value applied in the gain unit 54 to the ambient noise signals received from the noise microphone 48 can be set to a relatively high value, and this will be suitable for providing effective noise cancellation across the range of leakage values that can be achieved.

There is therefore provided an earphone that allows noise cancellation circuitry to provide signal processing that deals more effectively with the ambient noise that can reach the ear of the user.

The invention claimed is:

1. A noise cancelling earphone system, comprising:

an earphone, having a microphone for detecting ambient noise and generating an ambient noise signal, and a speaker, and signal processing circuitry, connected to the microphone and to the speaker, wherein the speaker is located in the earphone for directing sound through an aperture provided in a front surface of the earphone, wherein the signal processing circuitry is adapted to receive the ambient noise signal from the microphone, and to apply the ambient noise signal to a filter having a controllable amount of gain, for generating a noise cancellation signal for transmission to the speaker, and wherein the earphone is provided with a plurality of ridges on the front surface thereof, the ridges defining at least one sound leakage channel across the front surface such that, however the earphone is worn within the outer ear of a user, an amount of sound leakage past the earphone into the ear canal of the user lies within a predetermined range.

2. A noise cancelling earphone system as claimed in claim 1, wherein the controllable amount of gain to be applied by the signal processing circuitry falls within a relatively narrow range.

3. A noise cancelling earphone system, comprising:

an earphone, configured to be worn within the outer ear of a user, the microphone comprising a speaker, located within the earphone for directing sound into the ear canal of the user when the earphone is being worn within the outer ear, and the microphone further comprising a microphone for detecting ambient noise approaching the ear of the user and generating an ambient noise signal, and signal processing circuitry, connected to the microphone and to the speaker, wherein the signal processing circuitry is adapted to receive the ambient noise signal from the microphone, and to apply the ambient noise signal to a filter having a controllable amount of gain, for generating a noise cancellation signal for transmission to the speaker, the signal processing circuitry being configured such that the speaker generates a sound that cancels ambient noise that passes around the earphone to enter the ear canal of the user, wherein the earphone is shaped such that, however it is worn within the outer ear of a user, an amount of sound leakage around the earphone to the ear canal of the user lies within a predetermined range.

* * * * *